United States Patent [19]

Brown et al.

[11] Patent Number: 4,970,775

[45] Date of Patent: Nov. 20, 1990

[54] BATCH FABRICATION OF FREQUENCY SELECTIVE LIMITER ELEMENTS

[75] Inventors: Stephen A. Brown, Baltimore; Chester L. Brewer, III, Millersville; Smith Paul S., Columbia, all of Md.

[73] Assignee: Westinghouse Electric Corp., Pittsburgh, Pa.

[21] Appl. No.: 490,536

[22] Filed: Mar. 5, 1990

Related U.S. Application Data

[63] Continuation of Ser. No. 411,957, Sep. 25, 1989, abandoned.

[51] Int. Cl.[5] ..... H01F 41/14

[52] U.S. Cl. ..... 29/602.1; 29/414; 333/17.2; 333/24.2; 427/130; 427/131

[58] Field of Search ..... 29/602.1, 607, 608, 29/604, 414; 427/130, 131; 333/17.2, 24.2

[56] References Cited

U.S. PATENT DOCUMENTS

| | | |
|---|---|---|
| 4,005,375 | 1/1976 | Pringle et al. . |
| 4,044,357 | 8/1977 | Goldie . |
| 4,155,053 | 5/1979 | Stitzer et al. . |
| 4,243,697 | 1/1981 | Glass et al. . |
| 4,251,786 | 2/1981 | Goldie et al. . |
| 4,283,692 | 8/1981 | Adam . |
| 4,325,140 | 4/1983 | Stitzer . |
| 4,488,122 | 12/1984 | Wolkstein . |
| 4,595,889 | 6/1986 | Stitzer et al. . |
| 4,642,584 | 2/1987 | Funck et al. . |
| 4,675,682 | 6/1987 | Adam et al. . |
| 4,690,726 | 9/1987 | Luther et al. . |
| 4,754,243 | 6/1988 | Armstrong et al. . |
| 4,845,439 | 7/1989 | Stitzer ..... 333/17.2 |

*Primary Examiner*—Carl E. Hall

*Attorney, Agent, or Firm*—W. G. Sutcliff

[57] ABSTRACT

A plurality of frequency selective limiting units are prepared on a common substrate. A plurality of generally linear signal carrying conductors are formed in spaced relation on a first ferrite member, the opposite side of which contains a lower ground plane. A second ferrite member is bonded to the first ferrite member with a nonconductive adhesive to form a layered structure. Grooves are formed in a free surface of the structure to a depth sufficient to cut through the first and second ferrite members and to expose the lower ground plane. The structure is metallized in a conformal manner so that the metallization is in contact with the lower ground plane. The units are separated by dicing to thereby provide a plurality of individual FSL's.

14 Claims, 3 Drawing Sheets

BATCH FABRICATION OF FREQUENCY SELECTIVE LIMITER ELEMENTS

This application is a continuation, of application Ser. No. 07/411,957 filed Sept. 25, 1989, now abandoned.

BACKGROUND OF THE INVENTION

1. Field of the Invention

This invention relates to an attenuatinq element which utilizes a yttrium-iron-garnet (YIG) material, and more particularly to a method of fabricating a plurality of such elements at one time.

2. Description of the Related Art

Frequency selective limiters (FSL) or attenuating devices which utilize a yttrium-iron-garnet (YIG) material have the property of being able to attenuate higher power level signals while simultaneously allowing lower power level signals, separated by only a small frequency offset from the higher level signals, to pass with relatively low loss. YIG-based FSL's are capable of limiting or attenuating across more than an octave bandwidth in the 2–8 GHz range. Higher power level (above-threshold) signals within a selectivity bandwidth will be attenuated without requiring tuning of the FSL. Lower power level (below-threshold) signals separated from the higher power level signals by more than a few spinwave linewidths will pass through the FSL without experiencing any greater loss than if the higher power level signals were not present. For an attenuating device based on YIG, this selectivity bandwidth is on the order of between 20–50 MHz.

A portion of a fully assembled FSL is illustrated in perspective in FIG. 1. Signal carrying conductor 12 is positioned between first and second YIG layers or slabs 14, !6 each having a generally planar configuration. The second YIG slab 16 has an overall length less than the overall length of the first YIG slab 14. As a result, the end portion 18 (one shown) of the signal carrying conductor 12 extends outwardly beyond the transverse edge 20 (one shown) of second YIG slab 16. The YIG slabs 14 and 16 and the signal carrying conductor 12 are supported on a metallized substrate 22 and are surrounded by a ground plane 24. Jumpers (not shown) may be utilized to serially connect a plurality of FSL's. The thickness of each YIG slab 14 and 16 may be varied to make the impedance of the signal carrying conductor 12 compatible with amplifiers and other external circuits (not shown). It has been found that increasing the thickness of the YIG slabs 14 and 16 increases the level of attenuation per unit length of YIG material at a given power level above some threshold power level. The apparatus shown in FIG. 1 is described in greater detail in a copending U.S. patent application entitled "Frequency Selective Limiting Device", Ser. No. 07/169,926, filed Mar. 18, 1988 in the name of Steven N. Stitzer et al. and assigned to Westinghouse Electric Corporation the assignee herein now U.S. Pat. No. 4,845,439 issued July 4, 1989.

The processing technique used thus far for making individual FSL units 10 has consisted of cutting all of the parts of the structure to final size from standard wafers, then processing the individual parts through a series of steps. Individual parts processing is labor intensive and uniformity in the final product is difficult to achieve on a regular basis. In addition, the expense involved in individual parts processing can be considerable.

SUMMARY OF THE INVENTION

The present invention provides a method for assembling a plurality of frequency selective limiting (FSL) units. A generally planar first ferrite member is secured to a metallized surface of a substrate layer. Thereafter a plurality of linear signal carrying conductors are placed on the first ferrite member in spaced relation. A second ferrite member is then bonded to the conductors and the first ferrite member with a nonconductive adhesive to form a multilayer structure. Grooves are cut into the multilayer structure between adjacent conductors. The grooves extend through both ferrite members exposing the metallized surface of the substrate layer. The upper surface and the grooves of the multilayer structure, are metallized in a conformal manner. The sandwich structure is then separated into a plurality of individual FSL units.

In a preferred embodiment, the first and second ferrite members are carried on respective supporting substrates. After each ferrite member is secured or bonded to the overall structure, their respective supporting substrates are ground off.

The metallized surface of the substrate layer and the metallized upper surface of the sandwich structure form an RF shield for containing the RF field lines generated by a signal flowing through the conductor to within the frequency selective limiting unit

DESCRIPTION OF THE PREFERRED EMBODIMENTS

Figure 1:
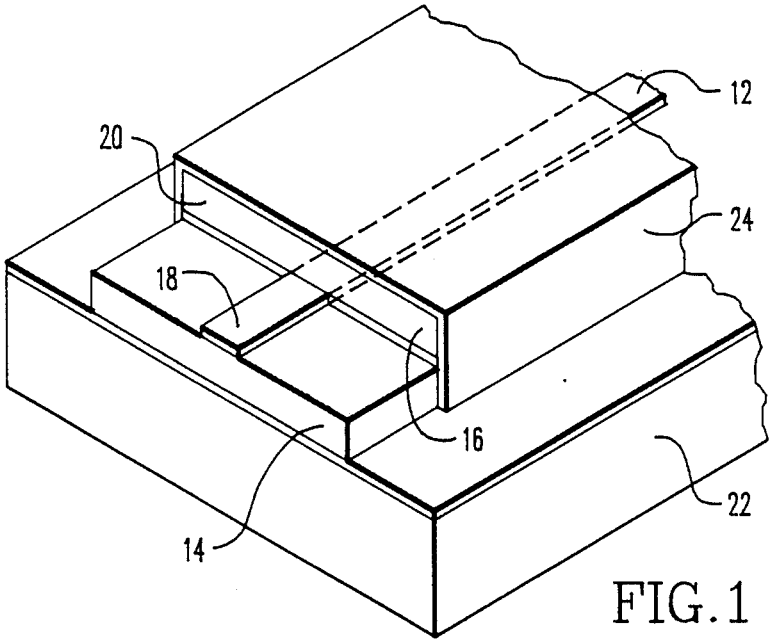
FIG. 1 is a perspective view of an FSL described in the above-referenced copending application.

The theory of operation and the construction of frequency selective limiting (FSL) devices which utilize a yttrium-iron-garnet (YIG) material are described in the following articles, which are incorporated by reference herein: "Frequency Selective Microwave Power Limiting in Thin YIG Films," *IEEE Transactions on Magnetics*, Vol. MAG-19, No. 5, September 1983, Steven N. Stitzer; "A Multi-Octave Frequency Selective Limiter," 1983 IEEE MTT-S Digest, page 326, Steven N. Stitzer and Harry Goldie; "Non-Linear Microwave Signal-Processing Devices Using Thin Ferromagnetic Films," *Circuits Systems Signal Process, Vol.* 4, No. 1–2, 1985, page 227, Steven N. Stitzer and Peter R. Emtage.

The present invention comprises a method for fabricating a plurality of YIG-based FSL elements at one time. Referring to FIGS. 2A–2L, only a fragmentary portion of a wafer is shown in cross-section at each major step of the process.

The starting materials for the process (FIG. 2A) are a nonmagnetic substrate 30 and a wafer 32 formed from a nonmagnetic substrate 34 having a layer of ferrite material 36 thereon. In the preferred embodiment, the nonmagnetic substrates 30 and 34 are gadolinium gallium garnet (GGG) wafers that are available commercially. The ferrite material 36 on the wafer 32 is an epitaxially grown yttrium iron garnet (YIG) dielectric film. The GGG wafer 34 provides support for the YIG film 36.

Although the substrates 30 and 34 are illustrated and described herein as being formed from GGG material, other suitable materials may be utilized. However, the material from which substrates 30 and 34 are formed should be selected to have a thermal expansion coefficient (TEC) which approximates that of the YIG film 36. For example, a high nickle alloy (70% Ni, 17% Mo, 7% Cr, 6% Fe), which has substantially the same TEC of the YIG ($\Delta L/L = 10.4 \times 10^{-6}/°$ C.) may be utilized if desired.

Figure 2A:
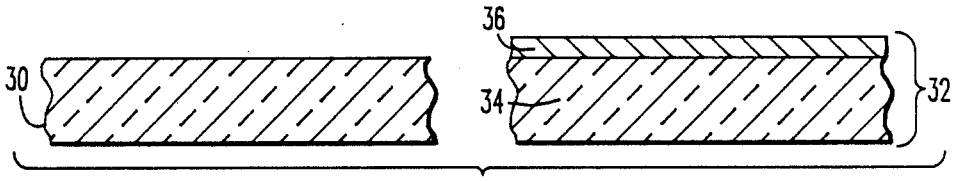
FIGS. 2A–2L present in a series of fragmentary side sectional views the sequence of steps for assembling a plurality of frequency selective limiting units.
Figure 2B:
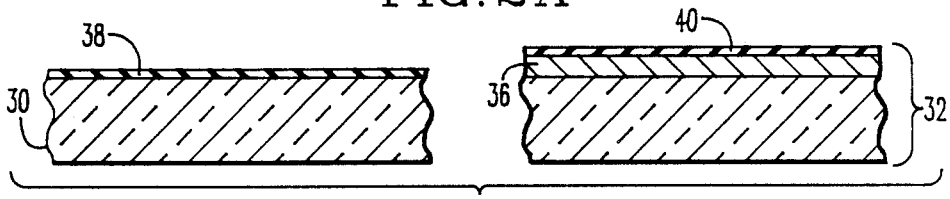
Figure 2C:
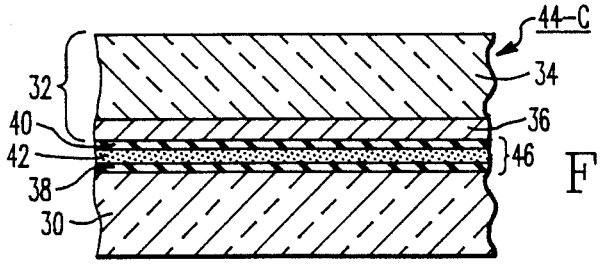

In the preferred embodiment, the GGG substrates 30, 34 are each approximately 18 to 22 mils thick and the YIG film 36 is approximately 4 mils thick. The substrates 30 and wafer 32 are metallized as shown in FIG. 2B with gold films 38 and 40 to a thickness of 2 microns The substrate 30 and wafer 32 are then bonded together by a conductive adhesive 42 with the two metallized surfaces 38 and 40 in confronting relationship as shown in FIG. 2C to form a multilayer structure 44-C. The metallized surfaces 38 and 40 and the conductive adhesive 42 form a lower ground plane 46 for the structure 44-C.

Figure 2D:
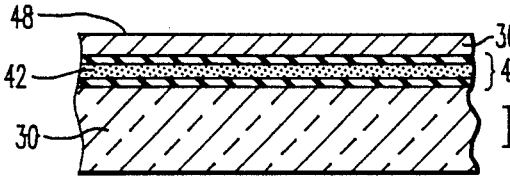

As shown in FIG. 2D the GGG substrate layer 34 is thereafter removed from the YIG layer 36 by a grinding and polishing procedure. The thickness and surface finish of the YIG layer 36 is then established by known lapping and polishing techniques. Preferably the YIG layer 36 should be approximately 3.6 to 4.4 mils.

The adhesive 42 is preferably a conductive epoxy preform sold commercially as Abelfilm ECF550 by Ablestick Labs a subsidiary of National Starch and Chemical Corporation. The preform 42 is normally supplied in the shape of a disc and is heat cured to form the bond. The preform 42 is approximately 5 mils thick and forms a sufficiently strong bond between the substrates 30 and 32 which is resistent to lateral forces such as shimmying associated with the removal of the GGG substrate layer 34 from the YIG layer 36.

Figure 2E:
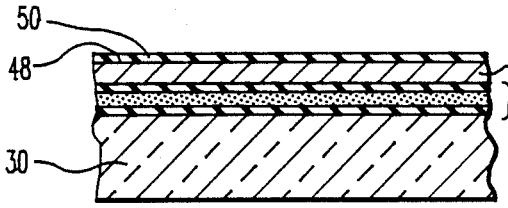

In FIG. 2E the upper surface 48 of the YIG layer 36 is metallized by a layer 50. The metallized layer 50 is preferably gold or other suitable material formed to an approximate thickness of 4 microns.

Figure 2F:
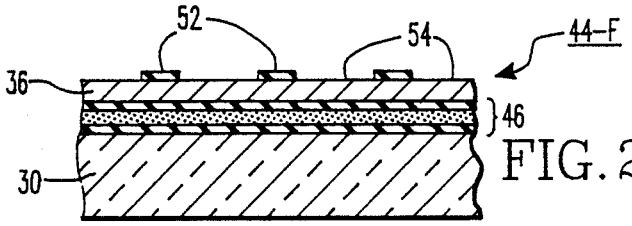

In FIG. 2F metallic signal conductors 52 are formed by removal of selected portions 54 of the film 50 leaving nonconductive gaps 54 between adjacent conductors 52. Known photolithographic techniques common in the microelectronic industry may be used to form the gaps 54 between the conductors 52.

Figure 2G:
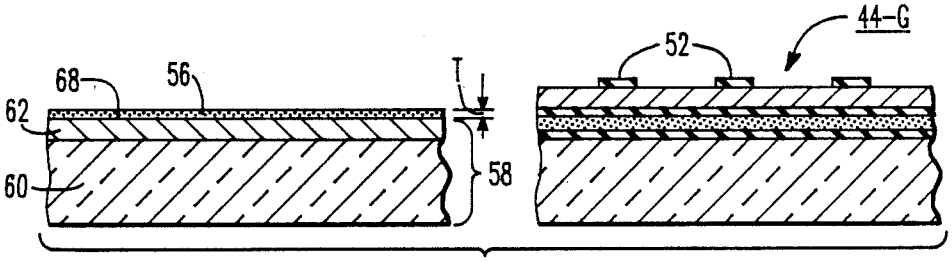

The multilayer structure 44-F (FIG. 2F) is further processed as follows. A wafer 58 comprising a GGG substrate 60 and YIG layer 62 shown in FIG. 2G is bonded in confronting relationship to the multilayer structure 44-G to thereby form the multilayer structure 44-H (FIG. 4H). Initially, a layer of nonconductive paste 56 is deposited on a surface 68 of the YIG layer 62 to provide adhesion between wafer 58 and the multilayer structure 44-G.

In order to provide good magnetic coupling between the conductors 52 and the YIG layer 62 it is important to control the spacing therebetween. Hence, it is important to control the thickness of the nonconducting paste 56 which bonds the ferrite layers 62 and 36. In general, the nonconducting paste 56 must be sufficiently thick so that its upper surface 64 is more or less coplanar with the upper surface 66 of each conductor 52 after wafer 58 is bonded to structure 44-G. Such an arrangement allows for proper bonding of the multilayer structure 44-G to the YIG layer 62. It is important that the paste 56 does not cover the upper surface 66 of the conductors 52. Ideally, any space between the YIG layer 62 and the conductors 52 should be as small as possible in order to provide maximum magnetic field coupling therebetween. Any gap reduces such magnetic coupling and is thus undesirable.

Figure 3:
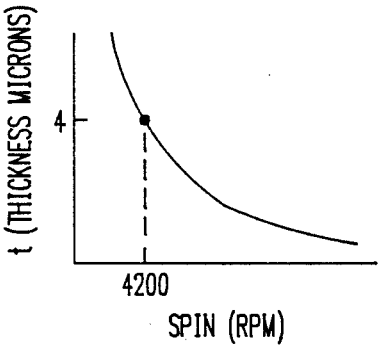
FIG. 3 illustrates graphically a spin curve representing the thickness of a nonconductive epoxy for a given spin rate.

In the preferred embodiment of the invention the nonconductive paste 56 is made from a combination of Epon® 828, (Shell Oil Co.) an epoxy resin and Versamid® 125 (Henkel Corp.) hardener that is thinned with varying proportions of ethylene glycol mono ethylether (Cellosolve®, Union Carbide Corp.) and xylene. The mixture is spun at various speeds to generate thickness data for the material. An exemplary graph of the thickness versus spin rate is shown in FIG. 3 for a nominal mixture. From the graph it is apparent that at a particular spin rate the material will form a film of a given thickness, determined from the curve. For various materials the spin rate and duration to achieve the desired thickness may be empirically determined without difficulty. The process is sufficiently accurate that a separate viscosity determination is not necessary. Numerous curves may be generated for different compositions of paste 56. Once the mixture and desired thickness are known the required spin rate may be taken from the respective spin curve.

During fabrication, the paste 56 is deposited on the surface 68 of the YIG layer 62. The structure is spun at a speed (and duration) determined from the spin curve (FIG. 3) to result in the desired thickness T. The paste 56 thus spreads to the desired thickness as shown in FIG. 2G. For a desired paste thickness T (equal to the thickness of conductors 52) of 4 microns, the spin rate is shown as 4200 rpm.

Figure 2H:
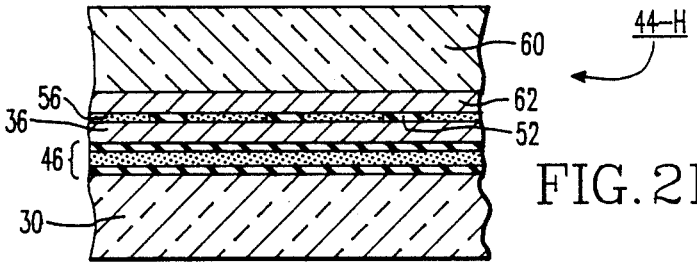
Figure 2I:
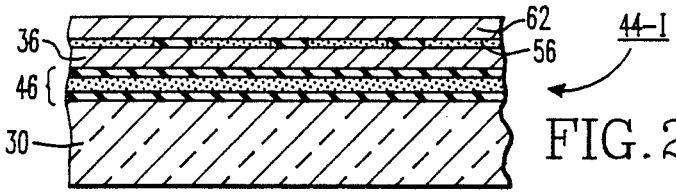

After the bonding step shown in FIG. 2H, the GGG substrate 60 is removed from the YIG layer 62 by a grinding and polishing procedure similar to that referred to with respect to FIG. 2D. The result is a multilayer structure 44-I illustrated in FIG. 2I.

Figure 2J:
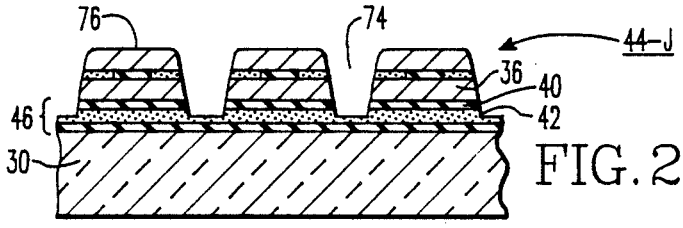
Figure 2K:
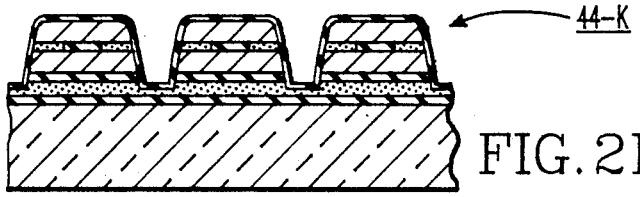
Figure 2L:
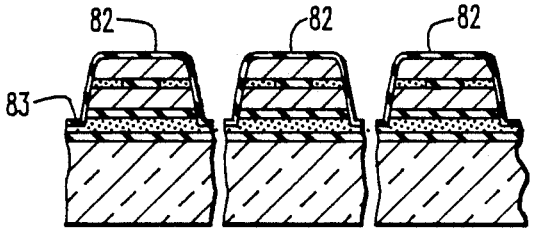

Referring to FIG. 2J, grooves 74 are formed in the structure 44-J (FIG. 2J). The grooves 74 extend through both YIG layers 62 and 36 and the metallized layer 40 immediately below the first YIG layer 36 to expose the conductive epoxy 42. Each of the signal carrying conductors 52 is thus physically separated from an adjacent conductor 52 as illustrated in FIG. 2J. The upper surfaces 76 of the structure 44-J including the grooves 74 are coated with a conformal layer of metal 78 thereby forming the structure 44-K illustrated in FIG. 2K. The metallized layer 78 is in electrical contact with the conductive epoxy layer 42 to thereby surround each conductor 52 with a ground plane. The structure 44-K is thereafter diced in order to produce individual FSL units 82 as illustrated in FIG. 2L. Ledges 83, formed on the FSL units 82, aid in making electrical contact. Each of the individual FSL units 82 is relatively uniform in physical and electrical characteristics. With the preferred design dimensions, the above batch sequence can produce 19 individual FSL elements from a single standard 3 inch wafer.

Although the invention has been described in terms of what are at present believed to be its preferred embodiments, it will be apparent to those skilled in the art that various changes may be made without departing from the scope of the invention. It is therefore intended that the appended claims cover such changes.

I claim as my invention:

1. A method for assembling a plurality of frequency selective limiting units comprising the steps of:

securing a generally planar first ferrite member to a substrate layer, said substrate layer consisting of either an electrically conductive material or a nonconductive material with a metallized surface;

placing a plurality of signal carrying conductors in spaced relation on said first ferrite member;

bonding a second ferrite member to said conductors and said first ferrite member with a nonconductive adhesive to form a multilayer structure;

cutting grooves into a free surface of said multilayer structure, to a depth sufficient to cut through said first and second ferrite members and to expose said substrate layer, said grooves being positioned between adjacent conductors;

depositing a layer of metal on said free surface and said grooves of said multilayer structure in conformal manner so that the layer of metal is in contact with said substrate layer; and separating said multilayer structure along the grooves into a plurality of individual frequency selective limiting units.

2. A method according to claim 1, wherein said substrate layer has a thermal expansion coefficient substantially equal to a thermal expansion coefficient of said first and said second ferrite members.

3. A method according to claim 1, wherein said nonconductive adhesive is coplanar with a free surface of said conductors.

4. A method according to claim 1, wherein said first and second ferrite members are made from a yttrium iron garnet material.

5. A method according to claim 1, wherein said conductors are made from gold.

6. A method according to claim 5 wherein the gold is about 4 microns thick.

7. A method according to claim 1, wherein said substrate layer is made from a gadolinium gallium garnet material with a metallized surface.

8. A method according to claim 1, further including the steps of:

securing said the first ferrite member to a support substrate before securing the first ferrite member to said substrate layer; and removing said support substrate from said first ferrite member after securing said first ferrite member to said substrate layer.

9. A method according to claim 1, further including the steps of:

securing the second ferrite member to a support substrate before bonding the second ferrite member to said conductors and said first ferrite member; and removing the support substrate from the second ferrite member after bonding the second ferrite member to said conductors and said first ferrite member.

10. A method according to claim 1, wherein the substrate layer and the layer of metal deposited on said multilayer structure form a ground plane for containing RF field lines generated by a signal flowing through said conductor.

11. A method according to claim 1 wherein the nonconductive adhesive is deposited between the conductors.

12. A method according to claim 11 wherein the nonconductive adhesive comprises an epoxy resin and hardener such that at a selected spin rate the adhesive forms a film on the first ferrite member to a thickness about the same as the conductors.

13. A method according to claim 12 wherein the nonconductive adhesive comprises Epon® 828 and Versamid® 125 hardener thinned with a mixture of ethylene glycol monoethyl ether and xylene.

14. A method according to claim 4 wherein the first and second ferrite members and the conductors have selected thicknesses for controlling an RF impedance of the frequency selective limiting units.

* * * * *